United States Patent [19]

Santoni

[11] 4,033,454

[45] July 5, 1977

[54] METHOD AND STRUCTURE FOR RETAINING SHIPPING DRUMS ON PALLETS

[75] Inventor: Cesar Santoni, Hamilton, Canada

[73] Assignee: Greif Bros. Corporation, Delaware, Ohio

[22] Filed: July 6, 1976

[21] Appl. No.: 702,458

[52] U.S. Cl. ..... 206/386; 220/321; 292/256.69; 214/10.5 R

[51] Int. Cl.[2] ..... B65D 19/00

[58] Field of Search ..... 220/319–321, 220/23.2, 23.4, 23.6, DIG. 1; 206/386, 443; 214/10.5 R, 152; 292/256.65–256.69

[56] References Cited

UNITED STATES PATENTS

| | | | |
|---|---|---|---|
| 3,028,993 | 4/1962 | Muhlhoff | 220/321 |
| 3,942,670 | 3/1976 | Mingus et al. | 206/386 |

*Primary Examiner*—George T. Hall

*Attorney, Agent, or Firm*—Kane, Dalsimer, Kane, Sullivan and Kurucz

[57] ABSTRACT

A method and structure is provided for retaining one or more drums on a pallet. The drum structure is normally in closure sealing the bottom end of the tubular body and either a cover or a closure for the top end of the body. The drum is provided with confining structure on at least one of the upper and lower ends which is adapted to capture a strap for securing the drum to the pallet. The confining structure is such that it facilitates the strapping of each drum of a plurality arranged in a group to a single pallet while capturing the straps and preventing slippage thereof from the drums. The confining structure can be in the form of protuberances or indentations and, in the case of the sealed drum, would be formed in at least the top seam of the drum and, in the case of a drum with a removable cover, can be formed in the clamping ring used to hold the cover on the drum.

31 Claims, 13 Drawing Figures

METHOD AND STRUCTURE FOR RETAINING SHIPPING DRUMS ON PALLETS

BACKGROUND OF THE INVENTION

In handling large commercial type drums it is often desirable to ship the containers on pallets and strap one or more of the containers to the pallet with conventional metal straps which are sealed at their adjoining ends to hold the drums in position. On occasion, with handling of large heavy drums during shipping operations, the straps have a tendency to slip particularly when the drums are tubular and cylindrical in configuration. Once the straps have partially slipped it is possible that they can come entirely loose from the drums in which case the drum would be free to fall from the pallets and be damaged or could possibly injure someone.

In general the types of drums under consideration are those which are sealed at the top and the bottom ends and the types which are sealed at the bottom end and have a removable cover on the top end which is normally held in tight interengagement with the drum by means of a conventional clamping ring such as that disclosed in U.S. Pat. No. 3,768,848.

In either case, the upper end seam of the drum of the sealed type and the outer surface of the clamping ring in the removable cover type have relatively smooth exterior surfaces which are not particularly helpful in retaining the strap in position when the drums are strapped to a pallet.

Accordingly, there is clearly room for improvement in the method of strapping the drums to the pallets and in particular in forming the drums and clamping ring structures with appropriate surfaces to facilitate holding the straps in position.

SUMMARY OF THE INVENTION

It is among the primary objectives of the present invention to provide a method and structure for retaining one or more empty or filled steel, fibre, plastic or other composite containers that may be either cylindrical or square in form and structure, to a pallet or other suitable platform manufactured of wood, fibreboard, or other materials for shipping and handling such containers. The system employs a metal or other type strapping to hold the containers or drums to the pallet or platform and structure is provided on the drum assembly to prevent slippage of the straps during shipping and handling.

In order to prevent the strapping used for retention purposes from slipping or sliding off of the sides and ends of the palletized containers, this invention incorporates either outward protuberances or gussets in pairs, or inward grooves or indentations on the exterior surfaces of the side and top faces placed both vertically and horizontally on the closing rings normally used to secure covers on containers that are fabricated with fully removble type tops. The protuberances or grooves form channels of the width and depth required to accommodate various width and gauges of strapping.

Furthermore, for nonremovable cover type containers, the indentations or grooves are placed on the top and/or bottom end seams of the container and are pressed inwardly on either or both the lateral and horizontal end surfaces to form a slot or groove in the required width and depth to accommodate strapping material. Once again, alternatively, protuberances can be provided on the same end seams for purposes of capturing and confining the straps and preventing slippage.

The outward protuberances or gussets, or inward grooves or indentations, can be placed singly or in pairs, positioned at 90° around the peripheral surface of the full open head drums and on the top and/or bottom seams of nonremovable head drums to allow for the use of single or multiple strappings to be applied to the sides and across the tops of one or several palletized containers. The containers are prepositioned on the pallet so that the strapping guide channels of one container are in alignment at 180° or 360° to allow for single or multiple transverse strapping across the top ends of the containers. For example, when one or more containers of the same capacity and shape are handled on a pallet, the strapping is applied by drawing one end under the base of the pallet and over the sides and across the tops of the containers, and the ends of the strapping, after tightening, are secured by means of either metal or composition type seals.

In summary, a method and structure for mounting large drums on a pallet is contemplated. The drum assembly is provided with appropriate confining means to receive and retain straps holding the drums to a pallet from slipping and sliding off the drums.

With the above objectives among others in mind, reference is had to the attached drawings.

DESCRIPTION OF THE PREFERRED EMBODIMENTS

Figure 1:
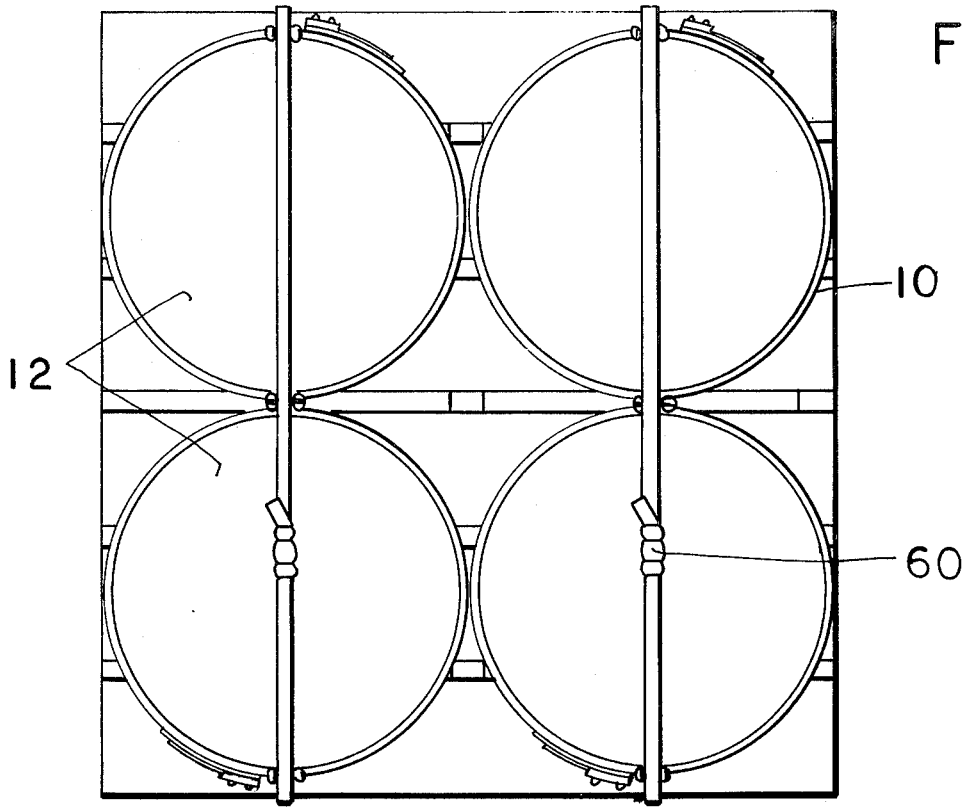
FIG. 1 is a top plan view of four drums of the removable cover type strapped to a pallet.
Figure 2:
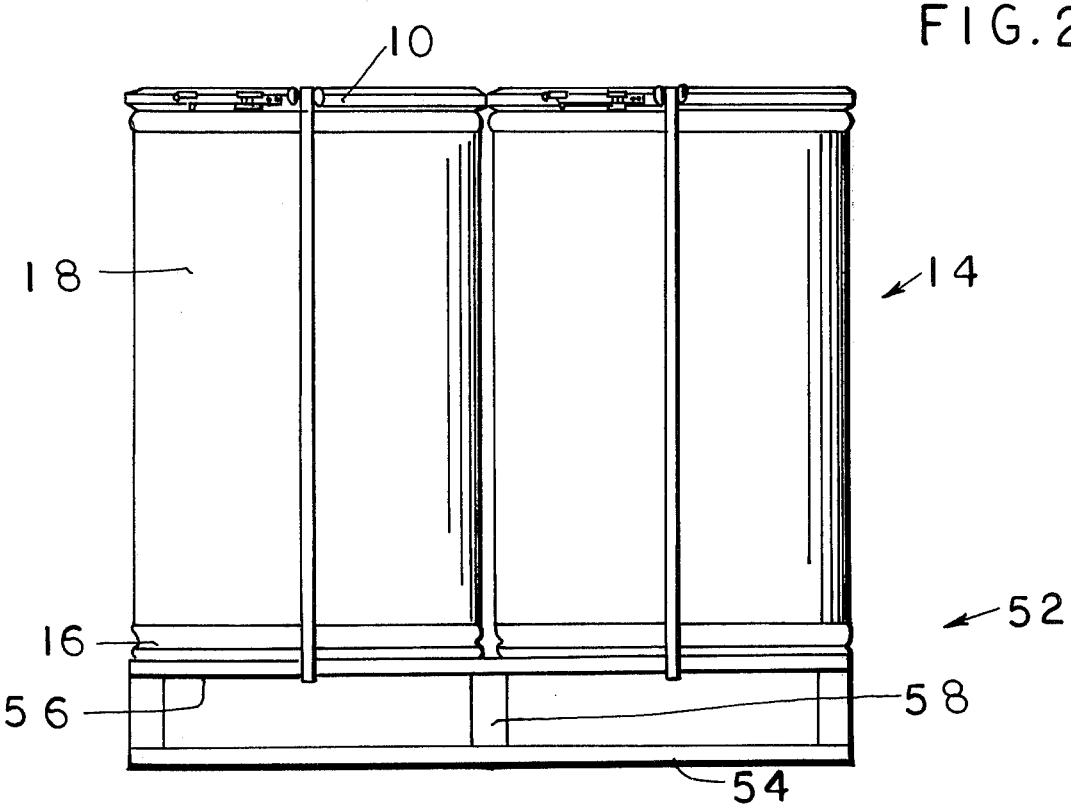
FIG. 2 is a side elevation view thereof.
Figure 3:
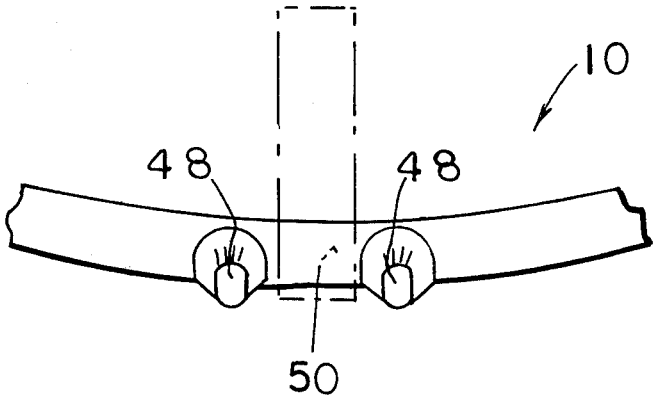
FIG. 3 is an enlarged fragmentary top view thereof showing the protuberances on the clamping ring portion of the drum assembly and a strap in phantom being held in position.
Figure 4:
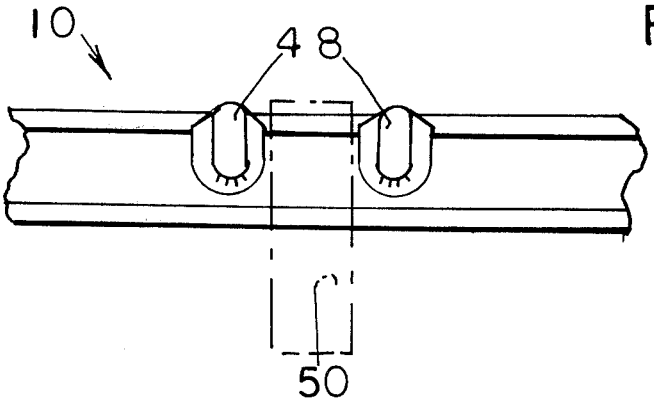
FIG. 4 is a fragmentary side elevation view thereof.
Figure 5:
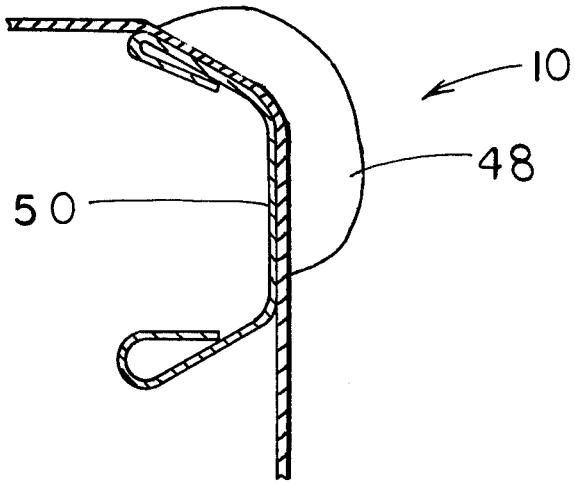
FIG. 5 is a cross sectional view thereof.
Figure 6:
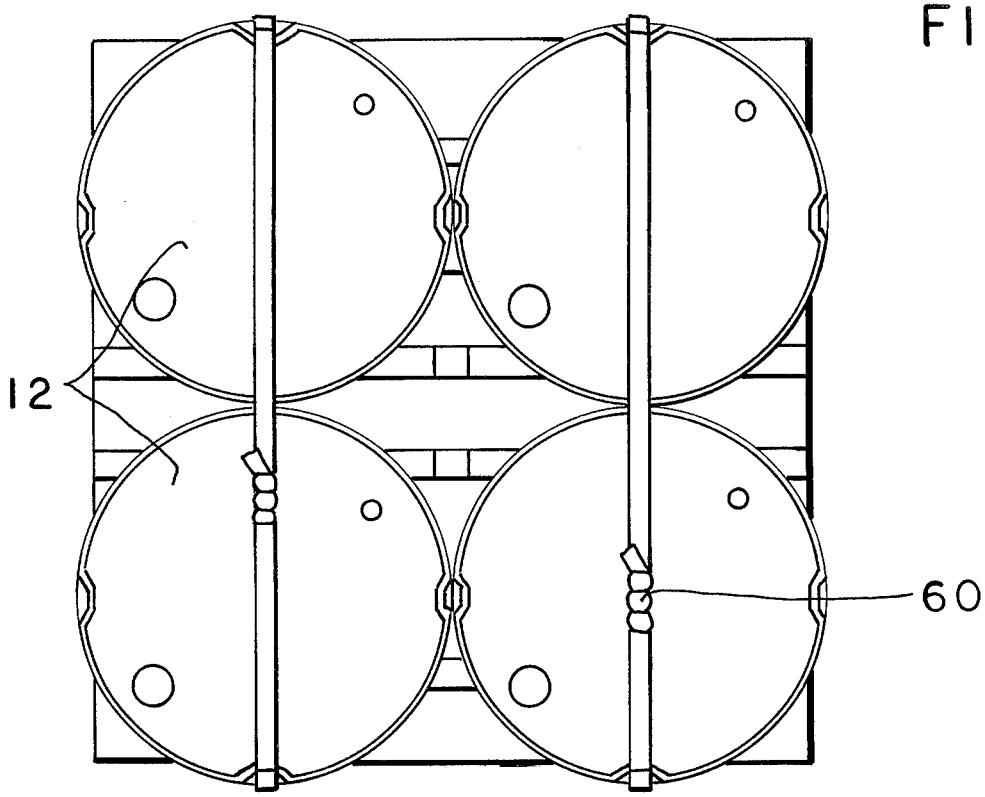
FIG. 6 is a top plan view of an alternative form of the invention showing four drums strapped to a pallet.
Figure 7:
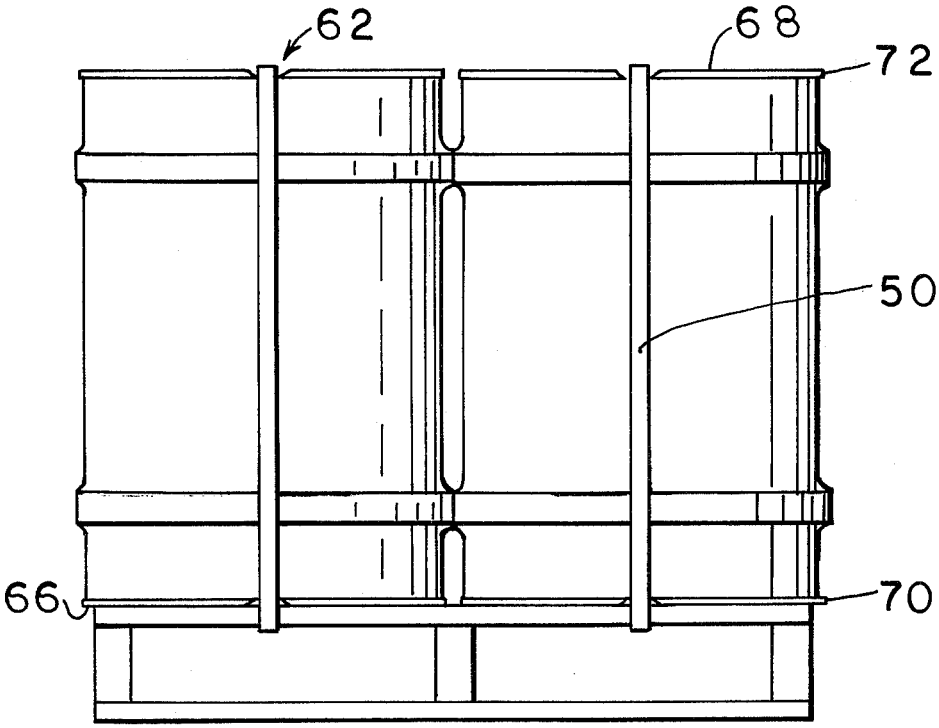
FIG. 7 is a side elevation view thereof.
Figure 8:
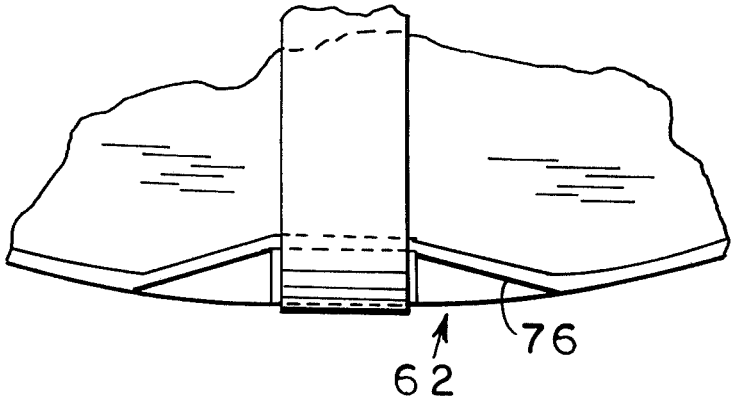
FIG. 8 is an enlarged fragmentary top plan view thereof showing a strap being held in position.
Figure 9:
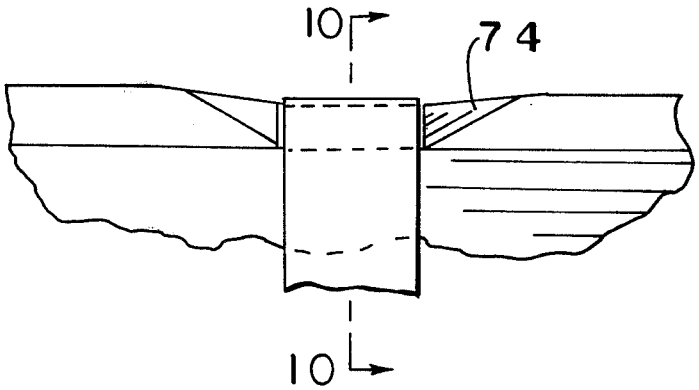
FIG. 9 is a fragmentary side elevation view thereof.

In the form of the invention illustrated in FIGS. 1–5 and 11, a clamping ring 10 serves to releasably close the cover 12 across the top opening of each drum or container 14. The drum 14 is a typical drum including a bottom closure 16 permanently sealed and secured to the lower peripheral edge of the tubular body 18. The tubular body 18 is open at its upper end and includes a typical chime portion defined by an outwardly turn substantially tubular bead which serves to support the peripheral portion of cover 12. The type of drums and clamping ring used to fasten cover 12 to tubular body 18 is the same type as that disclosed in U.S. Pat. No. 3,768,848 and may take the form of other well known conventional designs. The drum as well as cover may be formed of sheet steel or aluminum, convolutely or spirally wound laminated layers of craftboard, fibre or the like, reinforced plastics or combinations of fibre and metal or fibre or metal having coatings or linings therein.

Figure 10:
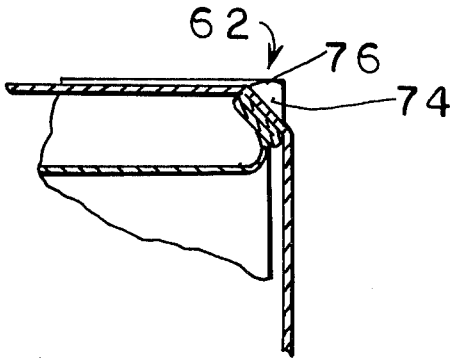
FIG. 10 is a cross sectional view thereof taken along the plane of lines 10—10 of FIG. 9.
Figure 11:
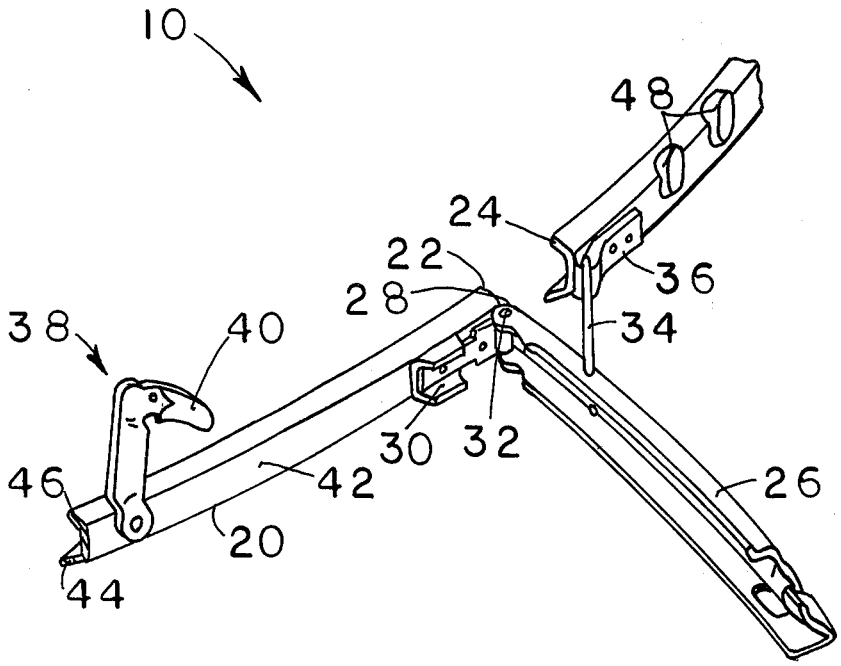
FIG. 11 is a fragmentary perspective view of the clamping ring used in the embodiment of FIGS. 1–5.

Clamping ring 10 in the form shown in FIG. 10 includes a split ring 20 made of suitable resilient metal such as steel and is provided with a locking mechanism connected between ends 22 and 24 thereby the ring may be expanded to permit its assembly around the cover 12 and drum 14 or contracted to tightly engage the assembled cover and container in holding the cover in place over the top of the drum in a manner well known in the art.

A locking lever 26 is pivoted or hinged at its base end 28 to a hinge strap 30 by means of pin 32. This hinge strap 30 is suitably connected and secured to end 22 of the split ring 20. The locking lever 26 is also pivotedly connected at an intermediate point to link 34 which is pivotedly connected to hinge strap 36 connected to the other ring end 24. Thus, when the lever 26 is pivoted outwardly relative to the split ring 20, the ring is expanded to permit its assembly about the combined cover 12 and drum 14; and when the lever is pivoted inwardly and eventually into engagement with the split ring 20, the ring is contracted to exert a compressive than holding force about the assembled cover and drum.

A latch 38 is pivotedly mounted on the split ring 20 between upwardly extending unlocked position to a horizontal locking position. Toward this end, the latch 38 is formed with locking finger 40 which will engage with the outer or free end of the lever 26 to retain the later in the locked position.

The main body portion of clamping ring 40 which is in the form of split ring 30 includes an annular base portion 42 and two inwardly extending angularly directed flanges 44 and 46 extending inwardly from the bottom and top of the base 42. At 180° intervals about the circumference of the clamping ring are two pairs of protuberances 48. Each of protuberances 48 are spaced a predetermined distance to permit a strap 50 to be passed therebetween. A single strap can be passed across the entire drum and be directed between the opposing pair of protuberances 48 and the strap is then held in position against sliding or slippage off the drum assembly surface when the drum assembly is closed and held in position by the clamping ring. Each protuberance 48 extends over a portion of the vertical base 42 of the clamping ring and onto the upper flange 46 thereby providing a vertical and horizontal surface for retaining the strap as it passes around the closed drum. The protuberances can be formed on the clamping ring by deformation of the ring itself or by mounting in a conventional fashion such as by welding or adhesives.

In the depicted embodiment where the clamping ring 10 is used to hold cover 12 to drum 14, there are four drums 14 mounted on a pallet 52 which is a conventional shipping pallet of square or rectangular configuration as shown. The pallet is formed with a support 54 and a base 56 spaced from the support and supported by upright members 58. In this manner, the strap 50 can be passed through the space between support 54 and base 56 and in interengagement with the under surface of base 56. The drums are mounted in vertical position on the pallet and as shown a strap 50 is used to fasten each pair of drums 14 to the pallet. The strap is passed under the surface of base 56 and over the adjacent pair of drums and the ends are fastened at a connection point 60 to form a continuous band. Each band 50 is passed between the opposing pairs of protuberances 50 on the clamping rings holding the lid 12 to the container body 14. In this manner, the straps are prevented from lateral slippage from the top surface of the drums by engagement with the protuberances which follow the path of the strap from the change of direction from vertical to horizontal as the strap passes over the top rim of the drum.

It is also contemplated that protuberances can be formed in the bottom end 16 of the container to retain the bottom end of straps 50 from slippage. Additionally, the number of drums mounted on a pallet 52 is a matter of choice depending upon shipment consideration such as volume and weight and the size of the pallet.

Figure 12:
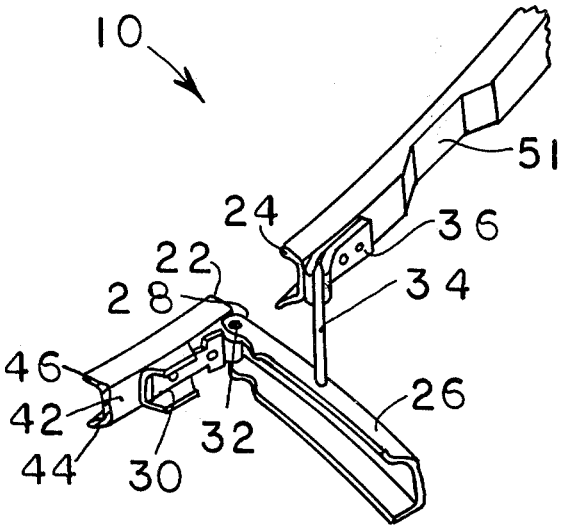
FIG. 12 is an alternative form of a fragmentary portion of a clamping ring used in the embodiment of FIGS. 1–5.

It is also contemplated that clamping ring 10 can be supplied with indentations 51, as shown in the embodiment of FIG. 12, in place of protuberances or even slotted portions to confine or retain the straps from the lateral slippage on the drum surface.

An alternate form of drum is depicted in FIGS. 6–10 in which indentations 62 are shown in lieu of the protuberances 48 of the previously discussed embodiment. Protuberances or slots can also be used in place of indentations 62 on this alternative form of drum for engaging and holding straps 50 in fixed position. The difference in the drum of FIGS. 6–10 lies in the fact that the drum 64 contains no removable cover. It is a drum which is provided with a sealed bottom end closure 66 and a sealed top end closure 68. The result is a pair of seams in the form of bottom seam 70 and top seam 72. Consequently, no clamping ring is employed to hold a removable lid on the container. The confining means in the form of indentations 62, as shown, is formed directly in bottom and top areas surrounding and forming seams 70 and 72.

Like the protuberances in the previously discussed embodiment the indentations 62 are formed so that they have a vertical component 74 and a horizontal component 76. In this manner, as the strap extends into a change in direction from a vertical to a lateral direction in surrounding and holding the drum in position on a pallet the vertical and horizontal components of the strap will both be held within the indentation.

In the depicted embodiment, there are four indentations 62 spaced about the upper rim 72 at 90° intervals and there are four corresponding indentations spaced about the bottom seam 70 at 90° intervals. The indentation 62 at the top are aligned with the indentation 62 at the bottom so that the strap can be attached to the drums in a straight and vertical position for maximum holding effect. Any tendency of the straps to slide off the drums is restricted by engagement with the surfaces forming the indentations 62. By providing indentations at 90° intervals it is possible to provide additional cross strapping along with the two straps 50 shown in the drawings.

The pallet 52 is identical to the pallet 52 of the previously discussed depicted embodiment and accordingly is provided with the same numerals in connection with mounting of the same type of straps 50 to hold the drums 64 in a similar arrangement of four drums on the pallet. The straps 50 are also connected in the same manner to have its ends secure at point 60.

This embodiment is particularly adaptable to a drum which includes a double seamed upper and lower end and is of a steel material although it is equally adaptable to drums of other materials of the types described above. The indentations are provided by deforming the seams and this can be easily accomplished without destroying the tightness and integrity of the double seamed top and bottom closures.

Figure 13:
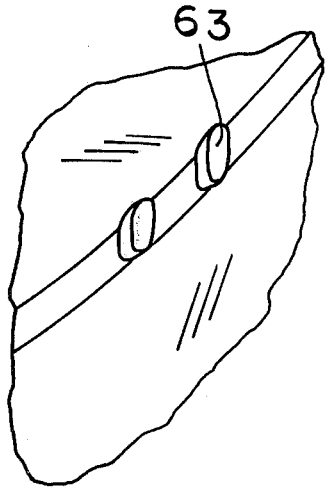
FIG. 13 is an enlarged fragmentary perspective view of an alternative form of the embodiment of FIGS. 6–10.

Alternatively, this type of sealed drum which does use a cover and clamping can also be provided with protuberances 63 instead of indentations 62 as shown in the alternative embodiment of FIG. 13.

The confining means of all types of embodiments described above whether it be in the form of protuberances, indentations or slots can be spaced above the periphery of both the top and bottom ends of the drums as desired and at angular intervals as desired. In this manner, single or multiple strappings can be employed for mounting the drums to pallets. The drums are positioned on the pallet in an arrangement such as that depicted and the confining structures are aligned properly whereupon the strapping is applied by drawing one end under the base 56 of the pallet and over the sides and across the tops of the drums. The ends of the strapping, after tightening, are secured at point 60 by means by either metal of composition type seals or other conventional fastening means. As discussed, the straps employed are adaptable for use on both fully removable covered type containers and non-removable tight head style containers. With the removal head type containers, the top and confining means is formed in the clamping or closing ring.

By use of metal or other type strapping one or more empty or filled steel, fibre, plastic, and other composite containers, that are both cylindrical and square in form and structure, can be secured to a pallet or other suitable platform manufactured of wood, fibreboard, or other materials for shipping and handling that type of container.

To retain the strapping from slipping or sliding off the drums, either outward protuberances or indentations or, if desired, slots are provided on the exterior surface of the side and top faces of the top and bottom edges of the closed container.

The confining structure is placed about the peripheral surface of the drums on the top and/or the bottom end to allow for the use of single or multiple strappings to be applied to the sides and across the tops of one or several palletized containers. The containers are prepositioned on the pallet so the strapping guide channel of one container are in alignment at 180° or 360° to allow for single or multiple transverse strapping across the top ends of the containers. For example, when one or more containers of the same capacity and shape are handled or shipped on a pallet, the strapping is applied by drawing one end under the base of the pallet and over the sides and across the tops of the containers, and the ends of such strapping, after tightening, are secured by means of either metal or composition type seals.

The types of strap retainers or confining structure used is contemplated for use on both removable cover type containers and non-removable tight head style containers.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A large drum adapted to be mounted on a pallet comprising; a tubular body having a bottom closure sealing the bottom end of the tubular body and a top closure sealing the top end of the tubular body, the drum adapted to be positioned on the pallet for engagement by at least one strap coupling the drum to the pallet, and confining means on the drum adapted to receive and retain the at least one strap from slipping off the drum used to fasten the drum to the pallet.

2. The invention in accordance with claim 1 wherein the drum has sealed closures on the top and bottom end forming top and bottom end seams for the tubular body.

3. The invention in accordance with claim 2 wherein the confining means includes at least one pair of protuberances on the upper seam and surrounding surface of the drum, the protuberances being spaced a predetermined distance apart to receive and retain a strap therebetween.

4. The invention in accordance with claim 3 wherein there are two pair of protuberances spaced approximately 180° on the upper seam and surrounding surface of the drum to receive a strap therebetween.

5. The invention in accordance with claim 4 wherein there are at least one pair of protuberances on the bottom seam and surrounding surfaces of the tubular body to receive a strap therebetween.

6. The invention in accordance with claim 1 wherein the confining means includes at least one indentation in the upper seam and surrounding surface of the drum dimensioned to receive a strap therein and restrain it from slipping off the drum.

7. The invention in accordance with claim 6 wherein there is at least one indentation in the bottom seam and surrounding surface of the drum to receive a strap therein and retain it from slippage from the container.

8. The invention in accordance with claim 7 wherein there are four indentations in the top seam and surrounding surface and four aligned indentations in the bottom seam and surrounding surface with each pair of aligned indentations being spaced 90° about the circumference of the drum from the next adjacent pair of aligned indentations.

9. The invention in accordance with claim 1 wherein four tubular drums are mounted on a rectangular pallet and are held in position by transverse metal straps fastened to the pallets and retained in position on the drums by the confining means.

10. The invention in accordance with claim 1 wherein the drum includes a tubular body with a bottom closure sealing the bottom end of the tubular body and a chime formed at the top open end of the tubular body, a cover is removably applied to the top open end of the tubular body and has a peripheral flange in overlapping relationship with the chime, a clamping ring having inwardly extending spaced flanges engaging with the cover flange and surfaces of the chime to close the cover on the drum, the confining means being formed on the outer surface of the clamping ring.

11. The invention in accordance with claim 10 wherein the clamping ring includes a split ring having two ends positioned substantially adjacent to one another, a locking lever pivotedly connected adjacent one of its ends with one of the ends of the split ring, linkage means for pivotedly connecting the other end of the split ring with an intermediate portion of the locking lever, the pivotal connections being so constructed and arranged so that the locking lever is shiftable from an open position away from the split ring at which the split ring is in an expanded position to a locking position adjacent surfaces of the split ring at which the split ring is in a contracted position, a hinge strap bend back upon itself to form a pivot bearing connected to said one end of the split ring and the locking lever hingedly connected at the bearing, a latch pivotedly connected with the split ring and adapted to be shifted from an unlatched position away from the split ring to a latched position in interengagement with the lever when the lever is in its locked position, the split ring of the clamping ring having its inwardly extending spaced flanges engaging with the cover flange and surfaces of the chime to close the cover on the drum when the lever is shifted to its locking position to contract the split ring, and the clamping ring being adapted to be removed from and reapplied to the cover and chime when the lever is shifted to its open position at which the split ring is expanded.

12. The invention in accordance with claim 10 wherein the confining means is at least one pair of protuberances on the outer surface of the clamping ring spaced to receive a strap therebetween and retain it in position on the drum.

13. The invention in accordance with claim 10 wherein the confining means is at least one indentation in the outer surface of the clamping ring of a predetermined size to receive a strap therein and retain it in position on the drum when the drum is mounted on a pallet.

14. An improved clamping ring for use in releasably holding a cover in assembled relationship with a drum and in assisting in retaining a strap in position on the drum when the drum is strapped to a pallet comprising;

a split ring having two ends positioned substantially adjacent to one another, a locking lever pivotedly connected adjacent one of its ends with one of the ends of the split ring, linkage means for pivotedly connecting the other end of the split ring with an intermediate portion of the locking lever, the pivotal connections being so constructed and arranged so that the locking lever is shiftable from an open position away from the split ring at which the split ring is in an expanded position to a locking position adjacent surfaces of the split ring at which the split ring is in a contracted position, a hinge strap bend back upon itself to form a pivot bearing connected to said one end of the split ring and the locking lever hingedly connected at the bearing, a latch pivotedly connected with the split ring and adapted to be shifted from the unlatched position away from the split ring to a latched position and into engagement with the lever when the lever is in its locked position, and confining means on the outer surface of the clamping ring adapted to receive and retain at least one strap from slipping when the strap is used to fastened the drum to the pallet.

15. The invention in accordance with claim 14 wherein the clamping ring forms part of a drum assembly which comprises, a drum having a tubular body, a bottom closure sealing the bottom end of the tubular body, and a chime formed at the top open end of the tubular body, a cover removably applied to the top open end of the tubular body and having a peripheral flange in overlapping relationship with the chime, the split ring of the clamping ring having inwardly extending spaced flanges engaging with the cover flange and surfaces of the chime to close the cover on the drum when the lever is shifted to its locking position to contract the split ring, and the clamping ring being adapted to be removed from and reapplied to the cover and chime when the lever is shifted to its open position at which the split ring is expanded.

16. The invention in accordance with claim 15 wherein the confining means is a pair of protuberances on the outer surface of the clamping ring spaced a predetermined distance apart to receive a strap therebetween.

17. The invention in accordance with claim 16 wherein two pairs of protuberances are on the clamping rings spaced at 180° intervals on the circumference thereof.

18. The invention in accordance with claim 16 wherein a pair of protuberances are positioned on the bottom end of the tubular body in alignment with each pair of protuberances on the clamping ring.

19. The invention in accordance with claim 14 wherein the confining means is at least one indentation in the outer surface of the clamping ring of predetermined size to receive a strap therein and retain the strap from slippage when the drum is mounted on a pallet.

20. The invention in accordance with claim 19 wherein there are four indentations on the clamping ring spaced at 90° intervals about the circumference thereof.

21. The invention in accordance with claim 15 wherein the confining means is at least one indentation in the outer surface of the circumference of the clamping ring and a corresponding indentation in the bottom end surface of the tubular body in alignment with an indentation in the clamping ring applied to the drum to facilitate retention of the strap in position on the drum when the drum is strapped to a pallet.

22. A method of mounting a drum on a pallet comprising; positioning a predetermined number of drums on a pallet with each drum having a tubular body having closed bottom and top ends and each drum being provided with confining means, and strapping the drum to the pallet with the confining means in position to prevent slippage of the straps holding the drum in position.

23. The invention in accordance with claim 22 wherein the confining means is at least one pair of protuberances on the upper closed end of the drum assembly with the pair of protuberances being spaced apart to receive a strap therebetween and retain it in position.

24. The invention in accordance with claim 22 wherein there are two pairs of protuberances spaced at 180° intervals at the upper end of the drum assembly to receive and retain a strap in position.

25. The invention in accordance with claim 23 wherein there is a pair of protuberances at the bottom end of the drum assembly in alignment with each pair of protuberances at the top end thereof to facilitate retention of the strap holding the drum assembly to the pallet.

26. The invention in accordance with claim 22 wherein the confining means is at least one indentation in the top end of the drum assembly having a predetermined dimension to receive and retain a strap therein and prevent it from slipping when the drum is strapped to a pallet.

27. The invention in accordance with claim 26 wherein there are four indentations on the upper end of the container assembly spaced at 90° intervals about the circumference to receive appropriate straps therein.

28. The invention in accordance with claim 26 wherein there is an indentation in the bottom end of each drum in alignment with each indentation in the top end thereof to facilitate retention of a strap therein when the drum is strapped to a pallet.

29. The invention in accordance with claim 22 wherein there are four drums mounted on a rectangular pallet and held in position by straps.

30. The invention in accordance with claim 22 wherein the drum is provided with a removable top closure held in position by a clamping ring and the confining means is on the clamping ring.

31. The invention in accordance with claim 22 wherein the drum has sealed top and bottom closures and the confining means is formed in at least the seam at the upper rim of the sealed drum assembly.

* * * * *

UNITED STATES PATENT OFFICE

CERTIFICATE OF CORRECTION

PATENT NO. : 4,033,454

DATED : July 5, 1977

INVENTOR(S) : CESAR SANTONI

It is certified that error appears in the above-identified patent and that said Letters Patent are hereby corrected as shown below:

In the Abstract:

Line 2, after "normally" insert --in the form of a tubular body having a--

Column 3, line 46, after "Each" insert --pair--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*